US008813909B2

(12) United States Patent
Bowden

(10) Patent No.: US 8,813,909 B2
(45) Date of Patent: Aug. 26, 2014

(54) CONTROL SYSTEM OF AN OPERATOR CAGE WITH ENHANCED SAFETY

(75) Inventor: Roger Bowden, Milton Keynes (GB)

(73) Assignee: NiftyLift Limited, Milton Keynes (GB)

( * ) Notice: Subject to any disclaimer, the term of this patent is extended or adjusted under 35 U.S.C. 154(b) by 0 days.

(21) Appl. No.: 13/387,043

(22) PCT Filed: Aug. 3, 2010

(86) PCT No.: PCT/GB2010/001467
§ 371 (c)(1), (2), (4) Date: Mar. 5, 2012

(87) PCT Pub. No.: WO2011/015814
PCT Pub. Date: Feb. 10, 2011

(65) Prior Publication Data

US 2012/0160604 A1 Jun. 28, 2012

(30) Foreign Application Priority Data

Aug. 7, 2009 (GB) ..... 0913774.6

(51) Int. Cl.
*E06C 5/34* (2006.01)
*B66F 11/04* (2006.01)

(52) U.S. Cl.
CPC ..... *B66F 11/044* (2013.01)
USPC ..... 182/18

(58) Field of Classification Search
USPC ..... 182/18, 2.1–2.11; 401/50
See application file for complete search history.

(56) References Cited

U.S. PATENT DOCUMENTS

| | | | | |
|---|---|---|---|---|
| 4,168,934 | A | 9/1979 | Downing et al. | |
| 4,366,881 | A * | 1/1983 | Frisbee | 180/271 |
| 4,456,093 | A | 6/1984 | Finley et al. | |
| 4,614,274 | A | 9/1986 | LaValle et al. | |
| 4,833,615 | A | 5/1989 | Bitner et al. | |
| 4,979,588 | A * | 12/1990 | Pike et al. | 182/18 |
| 6,145,619 | A | 11/2000 | Risser | |
| 6,272,413 | B1 | 8/2001 | Takahashi et al. | |
| 6,405,114 | B1 * | 6/2002 | Priestley et al. | 701/50 |

FOREIGN PATENT DOCUMENTS

| | | | | |
|---|---|---|---|---|
| GB | 2 329 166 | | 3/1999 | |
| JP | 2002114500 | A * | 4/2002 | B66F 9/24 |
| KR | 20090002074 | U | 3/2009 | |
| WO | WO 2009/037429 | | 3/2009 | |

OTHER PUBLICATIONS

International Search Report issued in PCT/GB2010/001467 mailed Dec. 1, 2010.
Search Report issued in GB0913774.6 dated Dec. 7, 2009.

* cited by examiner

*Primary Examiner* — Alvin Chin-Shue
*Assistant Examiner* — Kristine Florio
(74) *Attorney, Agent, or Firm* — Knobbe Martens Olson & Bear LLP

(57) ABSTRACT

A control system for a machine having an elevating operator cage, includes a control device (102), an input for activation signals (106), an input for control signals (108), an input for load signals (112) and an output for drive control signals (114), wherein the control device (102) is constructed and arranged to issue a stop drive control signal upon receiving a load signal, and to issue an override signal that overrides the stop drive control signal upon receiving an override input signal.

18 Claims, 8 Drawing Sheets

CONTROL SYSTEM OF AN OPERATOR CAGE WITH ENHANCED SAFETY

RELATED APPLICATIONS

The instant application is the U.S. National Phase under 35 U.S.C. §371 of International Application No. PCT/GB2010/001467 entitled CONTROL SYSTEM OF AN OPERATOR CAGE WITH ENHANCED SAFETY, filed Aug. 3, 2010, designating the U.S, which claims priority under 35 U.S.C §119(a)-(d) to Great Britain Patent Application No. 0913774.6, filed Aug. 7, 2009, the content of which are herein incorporated by reference in its entirety.

FIELD OF THE INVENTION

The present invention relates to a control system for a machine having an elevating operator cage, such as a mobile elevating work platform (MEWP). The control system may also be used for similar machines having elevating operator cages, such as forklifts or telescopic handling machines ("telehandlers"). The invention also relates to an elevating work platform having a control system for the operator cage.

BACKGROUND OF THE INVENTION

An elevating work platform conventionally consists of a base, an extending structure (for example a boom or other lifting structure) mounted on the base that may be articulated and/or telescopic, and an operator cage that is attached to the end of the extending structure. The operator cage provides the operator with an enclosed and protected area in which to stand while operating the machine. The cage also provides the operator with a platform from which to work when the cage is elevated. The base may be either static or mobile.

A safety hazard can occur both during operation of the platform and also when a MEWP is driven, as the operator may not notice an overhead obstruction and may be pressed against the control console, which in turn could lead to injury or death. Similar risks may also arise in other machines, for example telehandlers and forklifts, in which an operator cage is fitted as an attachment to the load-bearing forks.

An operator cage system that addresses this safety issue is described in international patent application WO2009/037429A, in which the control console is protected by a system that detects a force applied to the console, or to a displaceable handrail or support in the vicinity of the console. If the operator is pressed against the console, this activates a safety switch, which in turn interrupts the drive system of the lifting mechanism (and, if applicable, of the wheels) to prevent further movement of the cage, thus avoiding serious injury to the operator.

A problem with this system is that the operator is unable to override the safety system and must therefore rely on others to rescue him or her from being trapped. If a rescuer is not present, the operator may remain trapped for some considerable time.

It is an object of the present invention to provide an operator cage that mitigates at least some of the aforesaid disadvantages.

SUMMARY OF THE INVENTION

According to one aspect of the present invention there is provided a control system for a machine having an elevating operator cage, the control system including a control device, an input for activation signals, an input for control signals, an input for load signals and an output for drive control signals, wherein the control device is constructed and arranged to issue a stop drive control signal upon receiving a load signal, and to issue an override signal that overrides the stop drive control signal upon receiving an override input signal.

The stop drive control signal interrupts operation of the drive system of the lifting mechanism (and, if applicable, of the drive wheels) to protect the operator from injury. The override input signal allows the operator to override the stop signal and thus release him/herself from being trapped. Furthermore, the override input signal may allow the operator to override some or all other machine safety systems, such as a cage weighing system. The load signal may be generated by a sensor linked to the control console to detect a load applied to the console, or to another part of the operator cage. For example, it may be linked to the cage weighing sensor.

Advantageously, the override control input signal comprises a combination of input signals, to prevent unintentional overriding of the stop signal. Alternatively, the override control input signal comprises at least two activation signals from separate activation devices. Preferably, the activation device is shrouded and located in an area where the operator is unlikely to operate it inadvertently.

Preferably, the control device is constructed and arranged to issue a restricted drive control signal that operates to allow the machine to be operated at a reduced speed and/or only in certain directions. Alternatively, the restricted drive control signal operates to allow only specific components of the machine to be operated. This ensures that the operator is protected from further danger.

Advantageously, the control device is constructed and arranged to resume normal operation after receiving a load signal, only after the load signal has ceased and any control signal received at the time of receiving the load signal has been cancelled. This ensures that normal operation of the system is not resumed until all hazardous conditions have been cleared.

The control system may include a warning device for issuing a warning signal when a load signal is received. This warns both the operator and other nearby personnel of the hazardous situation.

Preferably, after issuing a stop drive control signal, the control device may issue a withdraw signal that causes the machine to reverse at least partially its movements prior to receiving the load signal. This relieves at least in part the force trapping the operator, without compromising the stability of the platform.

According to another aspect of the present invention there is provided a machine having an elevating operator cage, a control console, a load sensor that is constructed and arranged to sense an external load applied to the console, and a control system according to any one of the preceding statements of invention.

Advantageously, the console is mounted for pivoting movement, and the load sensor is constructed and arranged to detect movement of the console from an unloaded condition to a loaded condition. The load sensor senses external loads applied to the console. The sensor can help to protect the operator from danger in the event that the operator cage collides with an obstruction. The safety system is essentially covert, in the sense that it is not immediately obvious to an operator that the system is present. This reduces the chance that the operator will take less care when operating the machine. Furthermore, because the console can be formed as a one-piece unit, it is robust and simple to manufacture.

Alternatively or in addition, a load sensor may be provided for sensing other loads applied to the operator cage. For example, it may be linked to the cage weighing sensor.

Advantageously, the operator cage includes resilient biasing means that is constructed and arranged to bias the console towards the unloaded condition. This ensures that the safety system is not triggered by ordinary loads encountered during normal usage and only comes into operation when crush loads are present. The amount of pre-load applied to the console by the biasing means can preferably be adjusted according to the circumstances of use.

Advantageously, the console is constructed and arranged to be displaced from the unloaded condition only when the external load exceeds a predetermined value.

Advantageously, the load sensor includes a proximity switch.

Advantageously, the switch is normally closed. This provides for fail-safe operation, whereby operation of the machine is prevented if the switch fails or is missing. Alternatively, failure of a load sensor may cause the system to report a failure condition by visual and/or audible means and allow normal machine operation.

Advantageously, the load sensor is located within a closed compartment, to prevent unauthorised tampering.

Optionally, the cage may also include a load sensor that is constructed and arranged to sense external crush forces applied to an upper portion of the fence assembly.

Advantageously, the fence assembly includes an upper rail having a first portion that is positioned at a first height above the base unit and a second portion that is positioned at a second height above the base unit, wherein the second height is greater than the first height and the second portion is located above a gateway providing access to the operator cage. The raised second portion of the upper rail allows easier access to the operator cage through the gateway.

Preferably, the gateway includes a hinged gate below the second portion of the upper rail, wherein one end of the gate is mounted for pivoting movement and the other end is constructed and arranged to be retained by the fence assembly throughout its movement.

The raised second portion of the rail also serves as a guard that helps to protect an operator from injury when operating the machine. For example, if a conventional MEWP is driven backwards, the operator may not see an obstacle and may be pressed against the control console. The raised portion of the rail helps to protect the operator from colliding with the obstacle. The second portion may support one or more proximity sensors and/or crush sensors.

According to another aspect of the present invention there is provided a machine comprising a base, an extending structure and an operator cage attached to the extending structure, wherein the operator cage is as defined by any one of the preceding statements of invention, or any combination thereof.

Various embodiments of the invention will now be described, by way of example, with reference to the accompanying drawings, in which:

DETAILED DESCRIPTION OF THE PREFERRED EMBODIMENT

Figure 1:
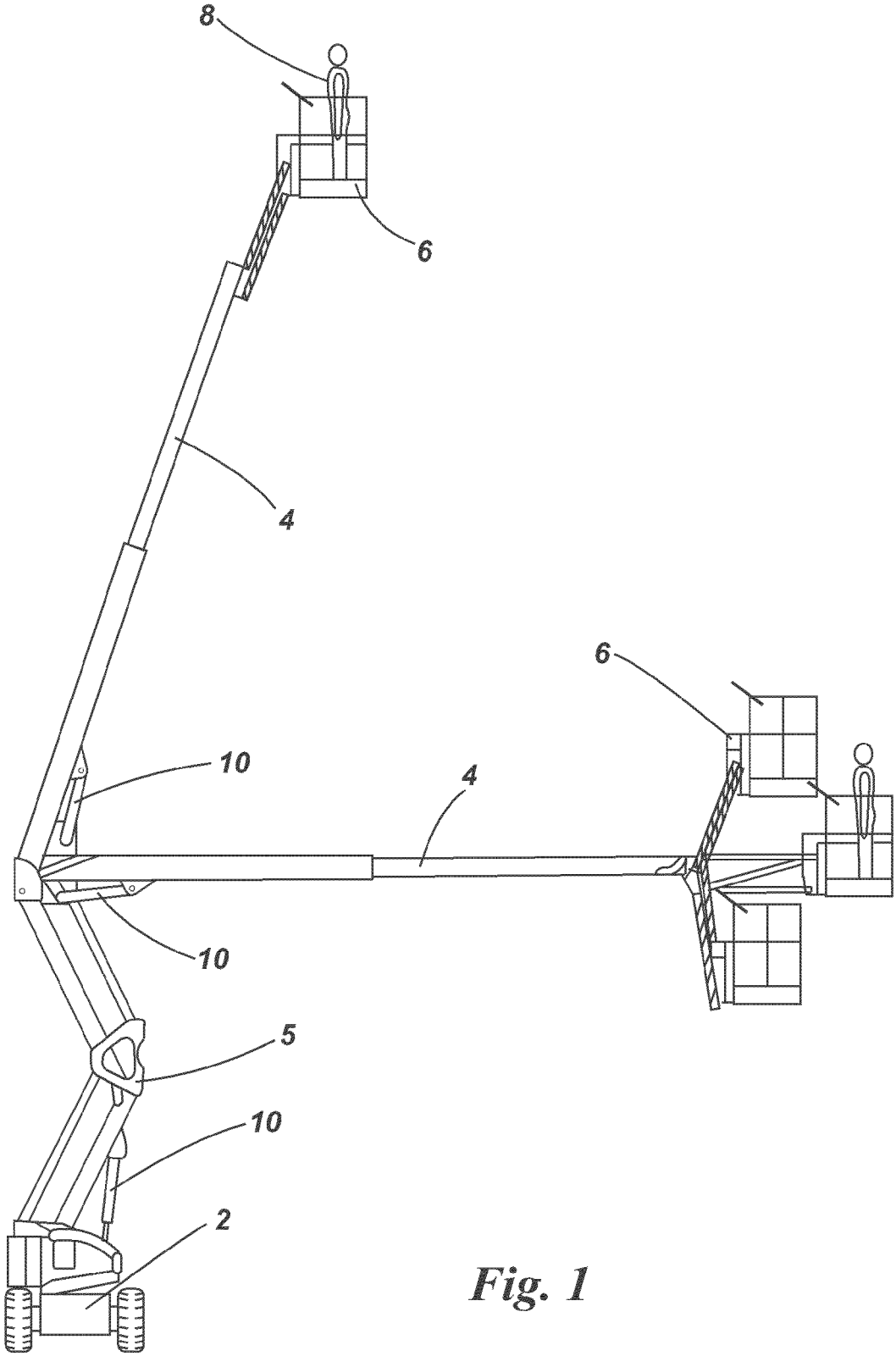
FIG. 1 is an end view of a typical mobile elevating work platform.

FIG. 1 shows a typical mobile elevating work platform, which includes a wheeled base 2, a hydraulically operated extending structure comprising a boom 4 and a lifting structure 5, and a cage 6 for a human operator 8. The boom 4, which is shown here in two different operating configurations, may be retracted and folded onto the wheeled base 2 for transportation or storage. Movement of the boom is controlled by various hydraulic cylinders 10, which are connected to a hydraulic drive system (not shown). Hydraulic motors may also be provided for driving the wheels of the wheeled base 2. Operation of the hydraulic drive system for the lifting structure, and if appropriate the wheels, is controlled by a control system illustrated in FIG. 11.

Apart from the operator cage 6, the components shown in FIG. 1 are all conventional and will not therefore be described in detail. It should be understood that the mobile elevating work platform may take various alternative forms.

Figure 11:
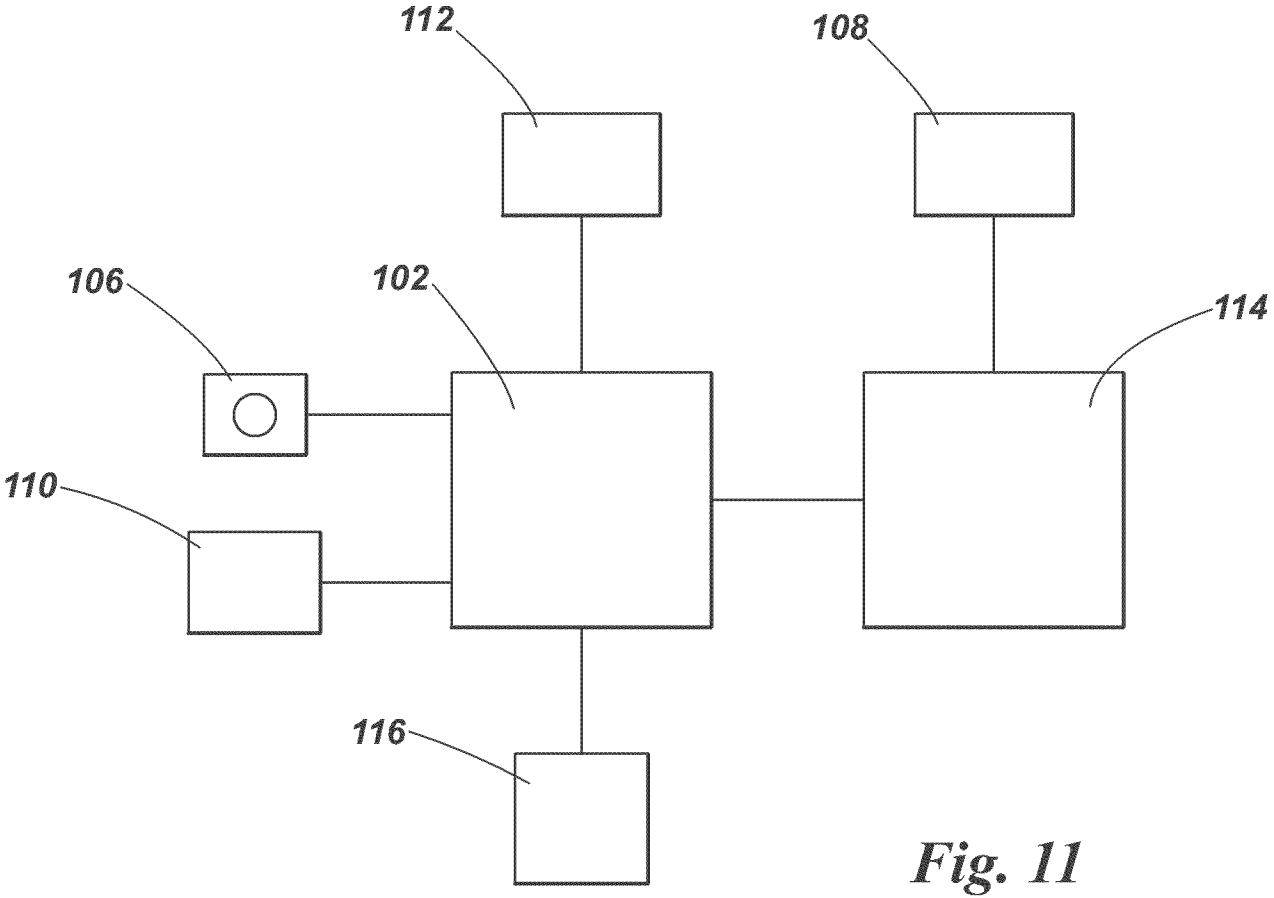
FIG. 11 is a system diagram illustrating the components of an operating system for a mobile elevating work platform.

The control system shown in FIG. 11 includes a control device 102, for example an electronic processor, which is connected to receive activation signals from an activation control 106 (or "green button") that is mounted in a console in the cage 6. Alternatively, an activation signal can be generated using a footswitch 110 mounted on the floor of the cage, which is connected to the control unit 104.

The control device 102 is connected to a load sensor 112 for sensing an excessive load applied to control console and/or to the operator cage. The load sensor 112 may therefore be arranged to detect a load applied to the console, for example if an operator becomes trapped against the console, or a load applied directly to the cage, for example if it collides with an obstruction. A load applied directly to the cage may for example be detected by sensing a change in the apparent weight of the cage, using a conventional cage weighing sensor.

The hydraulic drive system 114 for the elevating mechanism, and if provided the wheel motors, is connected to a set of drive controls 108 mounted in the console, which allow an operator to control operation of the work platform (if one of the activation controls 106,110 is also pressed). The hydraulic drive system 114 is connected to the control device 102, which is connected to the activation controls 106,110. This allows control signals from the activation controls to be detected by the control device 102. Preferably, the control system is arranged so that the control device is able to detect control signals from the drive controls 108. The control device 102 can also transmit control signals to the hydraulic drive system 114, allowing it to override or interrupt the control signals received from the activation controls 106,110 and/or drive controls 108.

The control device 102 may include a recording device (not shown) for recording control signals delivered to the hydraulic drive system 114 by the drive controls 108. This allows the control device 102 to keep a record of all movements of the operator cage prior to encountering an obstruction. This may be helpful for analysing causes of a collision and allows the cage to be released from the obstruction by reversing the sequence of movements. The recording device may be linked to a display device located on the base unit, allowing ground operators or rescuers to see the sequence of control signals carried out by the operator. They may then be able to effect a rescue or recovery operation by reversing some or all of those steps.

The control device 102 has an output connected to a warning device 116 for providing an audible and/or visible warning. The warning device may for example include a flashing device, which is preferably of an unusual colour such as blue to distinguish it from other red, orange or yellow warning lights frequently found on building sites. The warning device 116 may also include an audible alarm or an annunicator that is programmed to provide a suitable spoken warning or alarm. The warning device may also include an electronic messaging device for transmitting an alarm signal to a third party, for example using WiFi, Bluetooth, text messaging, email and so on. Preferably, the warning device has a delayed action, whereby the warning signal is delayed for a predetermined period, for example 5-15 seconds, before being sent. This allows a period of time for the system to be restored to a safe operating condition after an excessive load has been detected, thus avoiding unnecessary false alarms.

In use, the operator can control movement of the MEWP by holding down one of the activation controls 106, 110 while operating the appropriate drive controls 108. If neither activation control is held down, operation of the drive controls 108 will have no effect: this prevents inadvertent operation of the drive system. The drive system can be activated by holding down either the first activation control 106, which is normally a push button mounted on the console, or the foot pedal that serves as the second activation control 110. Alternatively, the machine may only be fitted with a footswitch that serves as the only activation control.

If an excessive load is sensed by the load sensor 112, as may be caused for example by the operator being trapped against the control console or by a change in the apparent weight of the cage being detected, the control device 102 senses the load signal from the load sensor and sends a stop signal to the hydraulic drive system 114, which immediately halts or interrupts operation of the drive system. This interrupts operation of the lifting mechanism to halt all movement of the lifting structure (including lifting, slewing and rotating movement). It also halts the wheel motors, if provided. This ensures that no further force is applied to the operator, so preventing serious injury. The control device 102 may also activate the warning device 116 to provide an audible and/or visible warning.

Optionally, after issuing the stop signal, the control device 102 may then issue a withdraw signal that causes the machine to reverse at least partially its movements prior to receiving the load signal. This may be accomplished for example by operating a relief valve in the hydraulic system, which allows some hydraulic fluid to escape, thereby reducing the pressure in the system. This automatically relieves some of the force applied to the trapped operator, without causing a large movement of the operator cage.

The operator is able to override the stop signal by holding down the override control, which is preferably the activation control 106, while simultaneously operating the appropriate drive control 108. However, if the operator was holding the activation control at the time the stop signal occurred, the operator must first release the activation control before override is possible. Override allows the operator to free him/herself. Holding down the override control, preferably the activation control 106, then generates an override signal, which is sensed by the control device 102. Upon receiving this override signal, the control device 102 permits movement of the cage in order to release the operator. The movement of the cage may however be limited to a very slow speed or to certain directions, to ensure that the load applied to the operator is not increased.

The override control, which is preferably the first activation control 106 on the control unit 104, preferably includes a lamp which is illuminated when the stop signal is issued, in order to remind the operator about the procedure for overriding the stop signal. An audible warning and/or vocal instructions may also be generated to assist the operator and/or rescuers. Alternatively, the override activation control may be located in a different location on the machine. The override activation control does not need to be an existing activation control, for example the green button on the console. Alternatively, the override activation control could be any activation control at any of the operating stations, for example the green button at the base controls or the footswitch in the cage.

Once the load has been removed, the load signal is cancelled. The operating system may then be returned to normal operation by returning all previously activated drive controls to the neutral position. Once this has been done, the control device 102 returns the system to normal operation.

The control system logic is designed to improve operator safety by preventing sustained platform movement that may lead to operator entrapment. The design therefore protects the operator from sustained involuntary machine operation against an obstacle, therefore reducing or eliminating operator injury.

Figure 12:
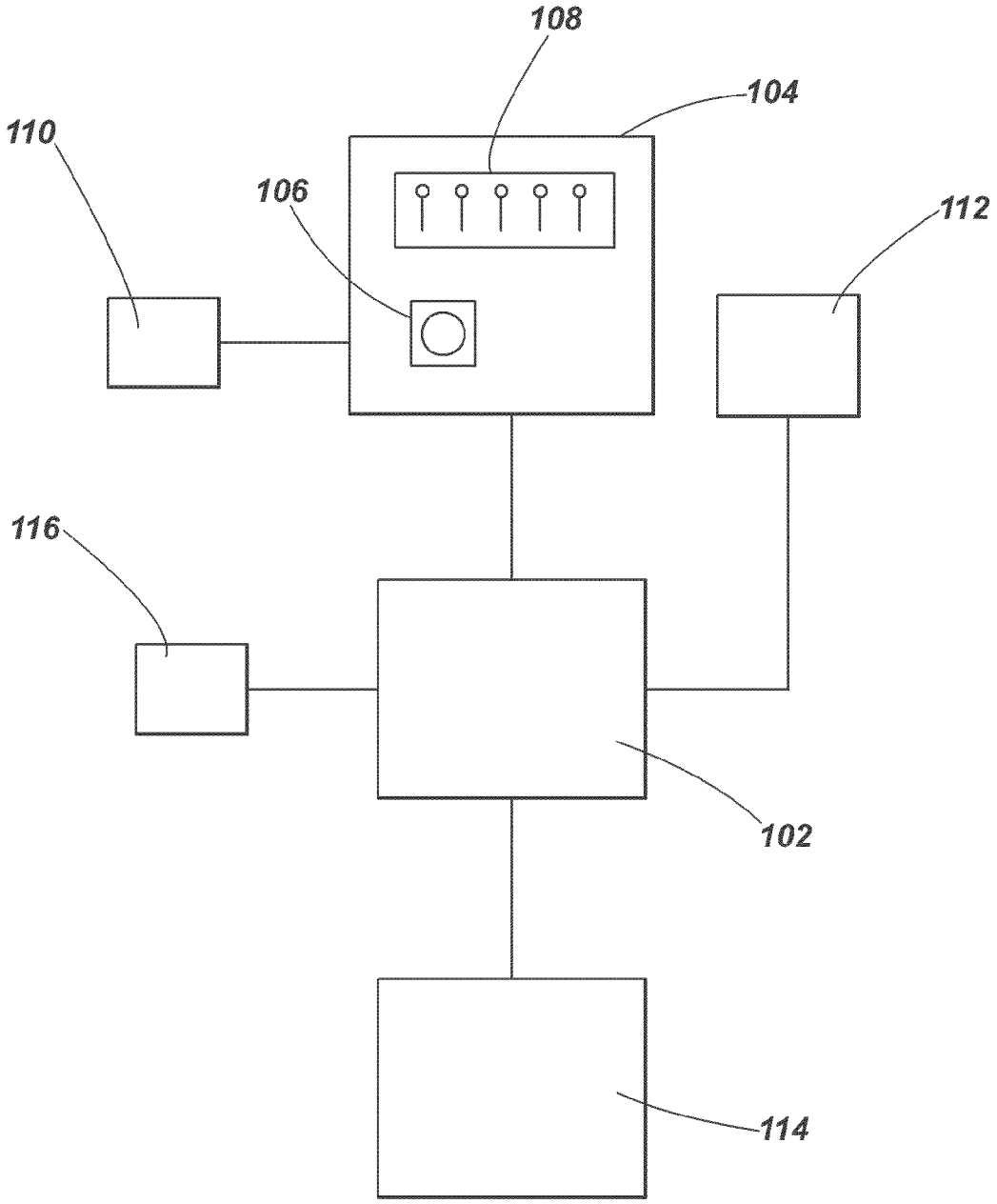
FIG. 12 is a system diagram illustrating the components of an alternative operating system for a mobile elevating work platform.

An alternative control system is shown in FIG. 12 and includes a control device 102, for example an electronic processor, which is connected to receive input signals from an operator control unit 104 that is mounted in a console in the cage 6. The input signals include activation signals from an activation control 106 (or "green button") and control signals from drive controls 108. Alternatively, an activation signal can be generated using a footswitch 110 mounted on the floor of the cage, which is connected to the control unit 104.

The control device 102 is connected to a load sensor 112 for sensing an excessive load applied to control console and/or to the operator cage. The control device 102 is also connected to the hydraulic drive system 114 for the elevating mechanism of the work platform and, if provided, the wheel motors. The control device 102 also has an output connected to a warning device 116. Operation of the alternative control system is substantially as described above in relation to the first control system.

Figure 13:
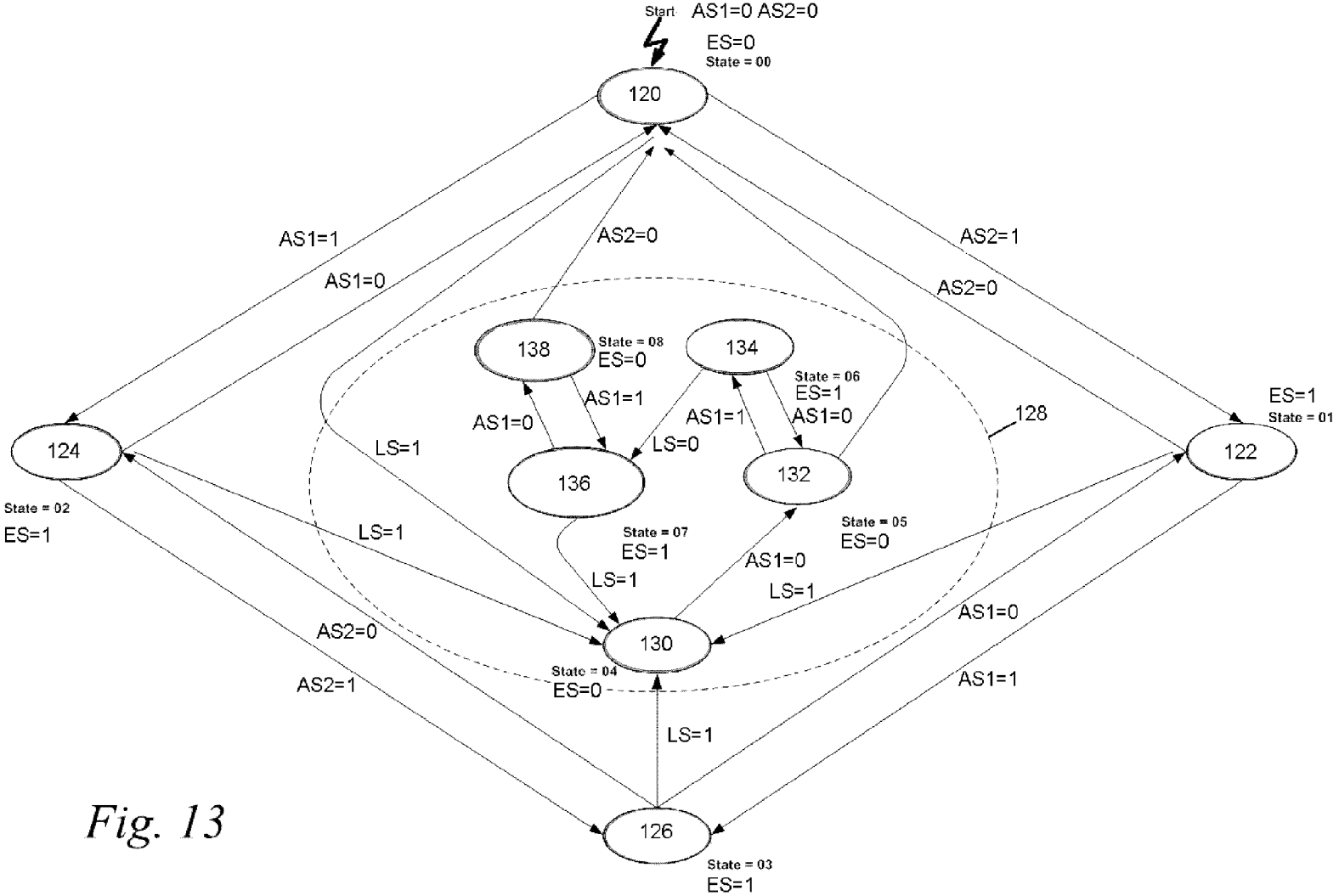
FIG. 13 is a state diagram illustrating various operational states of the control system.

Various operational states of the control system are illustrated in FIG. 13, in which the following abbreviations are used:

ES: machine enable state (1=on 0=off)

AS1: activation switch 1 (green button 106 in console or base unit)

AS2: activation switch 2 (foot switch 110)

LS: load sensor 112

The operational states encountered during normal operation of the system (when the load sensor 112 does not sense an excessive load) are as follows:

120 State=00: no activity, machine enabled by activation switch 1 (green button).

122 State=01: machine enabled by activation switch 2 (footswitch)

124 State=02: machine enabled by activation switch 1 (green button)

126 State=03: machine enabled by both activation switches.

The arrows represent the changes of state caused by operating the activation controls 106, 110. In each of the machine enabled states, an enable signal (ES=1) is generated.

The part of the diagram that falls within the inner ring 128 represents the operational states encountered when the system is in safety mode, when the load sensor 112 has sensed an excessive load. As previously indicated, the load sensor 112 may be linked to the console to detect an excessive load applied to the console, or to another part of the operator cage, for example the cage weighing sensor.

The operational states while the system is in the safety mode indicated by ring 128 are as follows:

130 State=04: load sensor activated

132 State=05: green button reset available

134 State=06: green button reset activated

136 State=07: load sensor released while override mode active

138 State=08: green button and load sensor both released.

As indicated by the arrows, if the load sensor 112 (or safety bar) senses an excessive load, the system adopts the load sensor activated state 130. In this state, the enable signal (ES) is cancelled and a reset warning signal is generated—this may take the form of a flashing green button light in the activation control 106.

If the green button activation control 106 is released, the system will adopt reset available state 132. Pressing the green button activation control 106 again will put the system into the green button only state 134, in which movement of the cage is permitted. This movement may optionally be restricted in speed and/or direction.

If the load sensor is released the system will adopt state 136 in which safety mode is still activated but operation is permitted under override mode. If the activation control is then released the system goes to state 138 and if the foot switch is released the system will return to the start mode 120, exiting safety mode. If the load sensor is again activated while the system is in state 136, the system will return to load sensor activated state 130.

The key functions provided by the system are as follows:

The system will stop all movements of the machine if the state of the load sensor changes from sensing the unloaded position of the console to the loaded position of the console.

An override mode is available to the operator once the load sensor has been activated to the loaded position, which will allow the operator to recover themselves to a safe position.

Override mode is demonstrated to the operator by illuminating the green button.

The system will only return the machine to normal operating mode if the console load sensors are in the unloaded position, and the control activation device being activated at the time the load sensor changed state (either the foot switch, green button, or both) is released.

The system may include visual and or audible warning signals or an annunciator to report the state of the machine and instructions to the ground and/or cage operators.

Additional safety can be provided by using the load sensing signal to initiate a hydraulic response from one or more machine functions. For example, a relief valve could be energised for a short period (from fractions of a second to several seconds) to release a measured amount of hydraulic oil, thus adjusting the machine's position slightly and removing the trapping load. This may be used on, but not limited to, levelling and luffing functions. The relief is designed to maintain the platform position to within a maximum angle from horizontal, for example, up to fifteen degrees.

The structure of the operator cage and the control console will now be described in more detail with reference to FIGS. 2 to 10.

Figure 2:
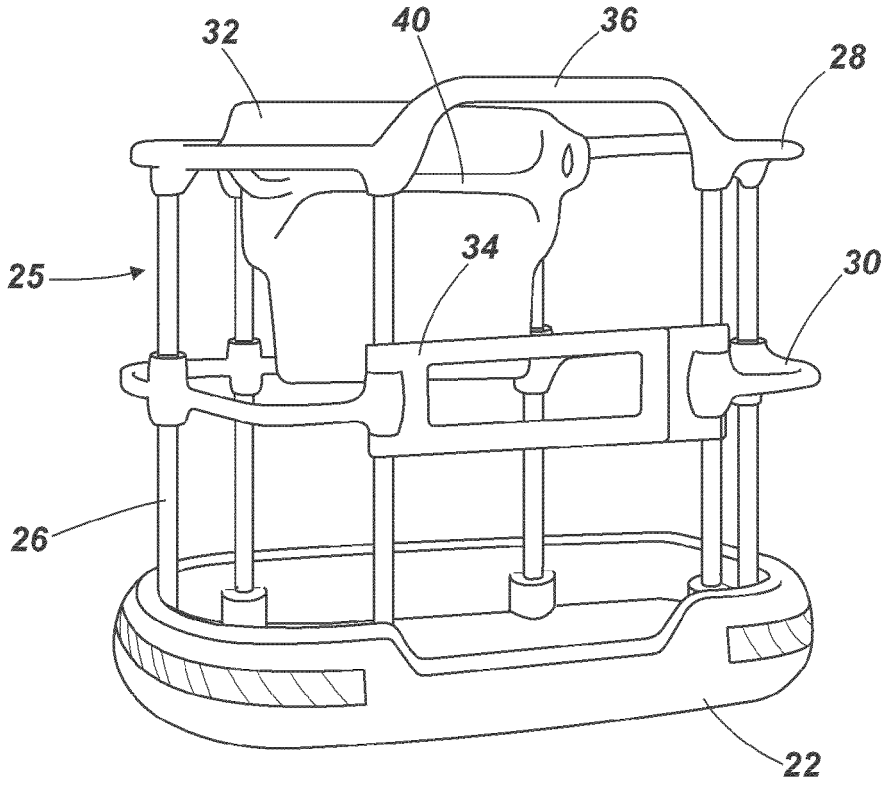
FIG. 2 is a perspective view of an operator cage.

The operator cage 6 shown in FIG. 2 includes a substantially rectangular base unit 22, a fence assembly 25 comprising six upright support posts 26, an upper guard rail 28 and a lower guard rail 30, and a control console 32. The lower guard rail 30 incorporates a gate 34 that allows access to the operator cage.

The base unit 22 and the control console 32 are preferably moulded plastic or composite components. The fence assembly 25 is preferably made of metal, for example welded steel or cast aluminium. Alternatively, the fence assembly 25 may be made of a plastics or composite material. The upper guard rail 28 includes an entry portion 36 that is raised to allow easy access to the cage. The raised portion 36 of the upper guard rail also provides protection from overhead obstructions while reversing.

The control console 32 preferably includes an integral hand rail 40 that extends across the front of the console and provides a barrier between the operator and the controls. This hand rail 40 provides the operator 8 with a support that he or she can hold to avoid overbalancing when manoeuvring the cage 6. This helps to prevent inadvertent operation of the controls if the operator reaches for support when overbalancing.

The console 32 carries the controls (not shown) for the MEWP drive system. The console is made as a single part moulding from a plastic or composite material. It is attached to the upper and lower guard rails in the front portion of the operator cage.

Figure 3:
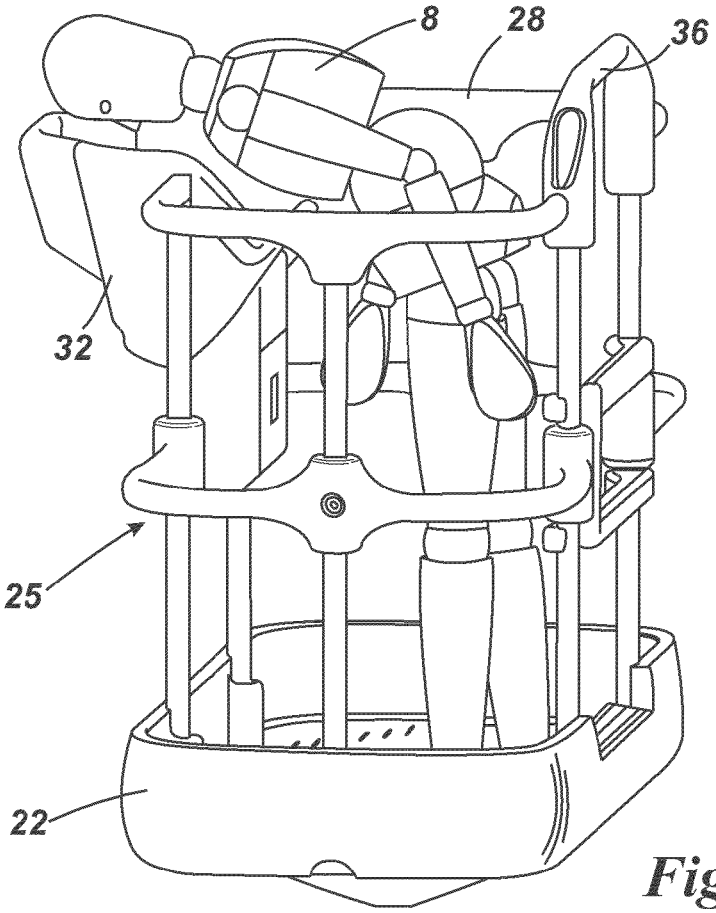
FIG. 3 is a perspective view of the operator cage in use, illustrating a hazardous situation.
Figure 4:
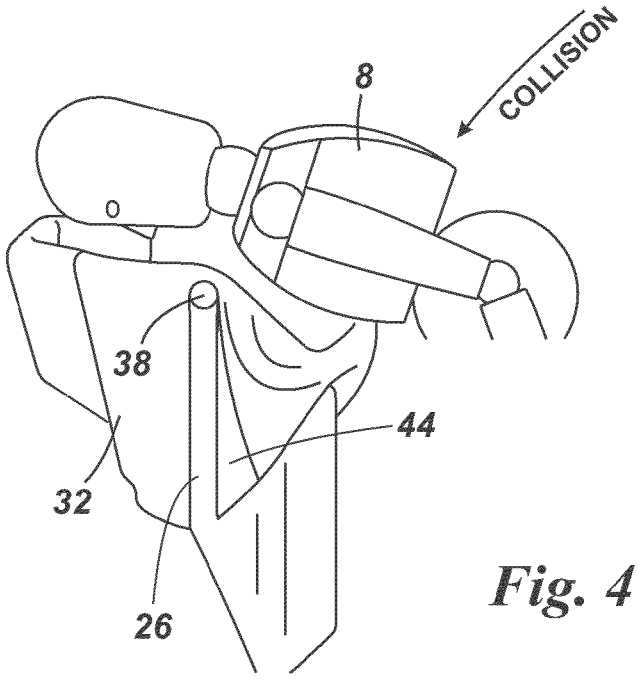
FIG. 4 is a perspective view at an enlarged scale showing part of the operator cage in use.
Figure 5:
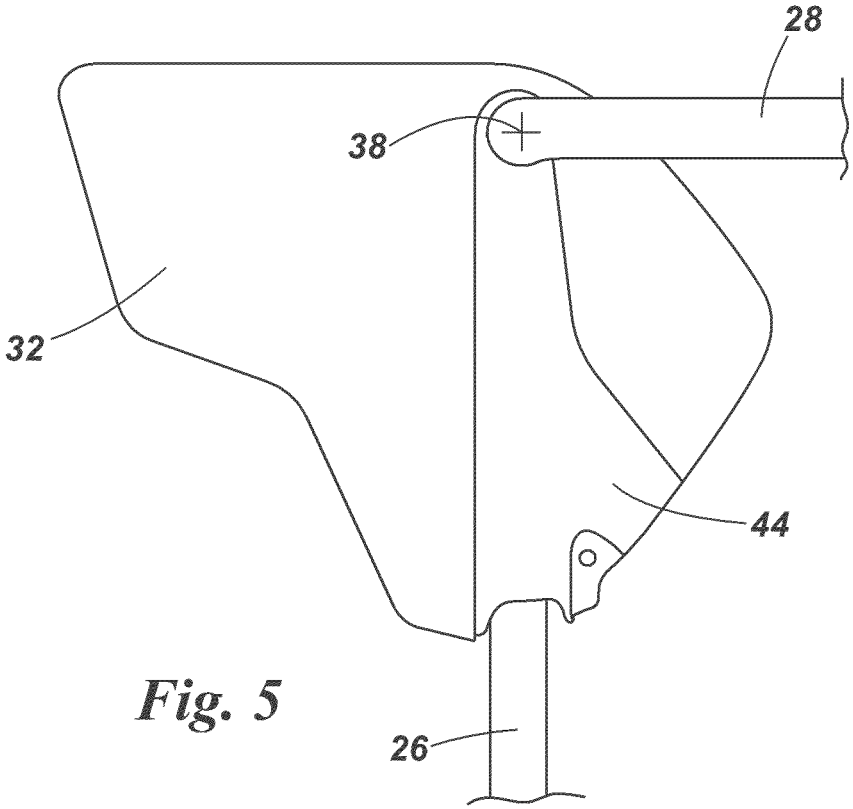
FIG. 5 is a side view at an enlarged scale of a control console.
Figure 6:
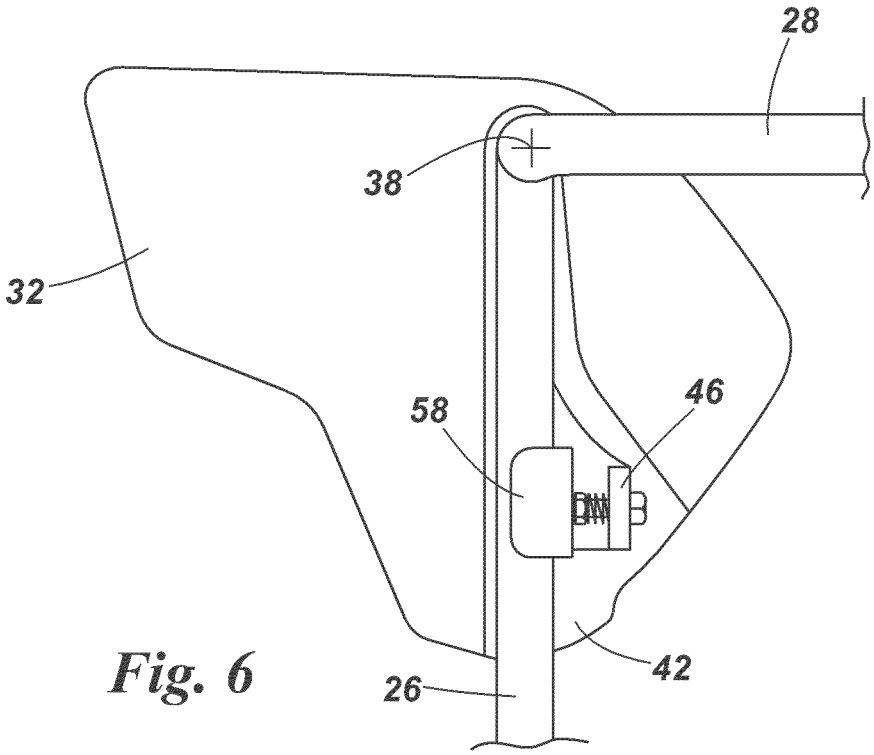
FIG. 6 is a side view of the control console with a side cover removed.

As shown in FIGS. 3 to 10, the console 32 includes a load sensor for sensing external load forces applied to the console, as may be caused for example by a collision between an obstruction (not shown) and the operator 8. Such a situation might arise for example when the operator cage 6 is being manoeuvred or driven backwards, if the operator 8 does not see the obstruction. As a result, the operator 8 might be trapped between the obstruction and the control console 32 as illustrated in FIGS. 3 and 4. This might cause a serious risk of injury, particularly if the operator 8 is trapped in a position that actuates the controls, causing the operator cage 6 to be manoeuvred further towards the obstruction.

In this embodiment, the control console 32 is supported by the upper guard rail 28 of the fence assembly 25 and is constructed and arranged for limited pivoting movement around the guard rail, which acts as a pivot 38 for the console. In order to allow for this pivoting movement, recesses 42 are provided in both sides of the console 32, which accommodate the vertical support posts 26 on either side of the console. These recesses 42 and the upper parts of the support posts 26 are normally hidden from view by removable cover plates 44.

Figure 8:
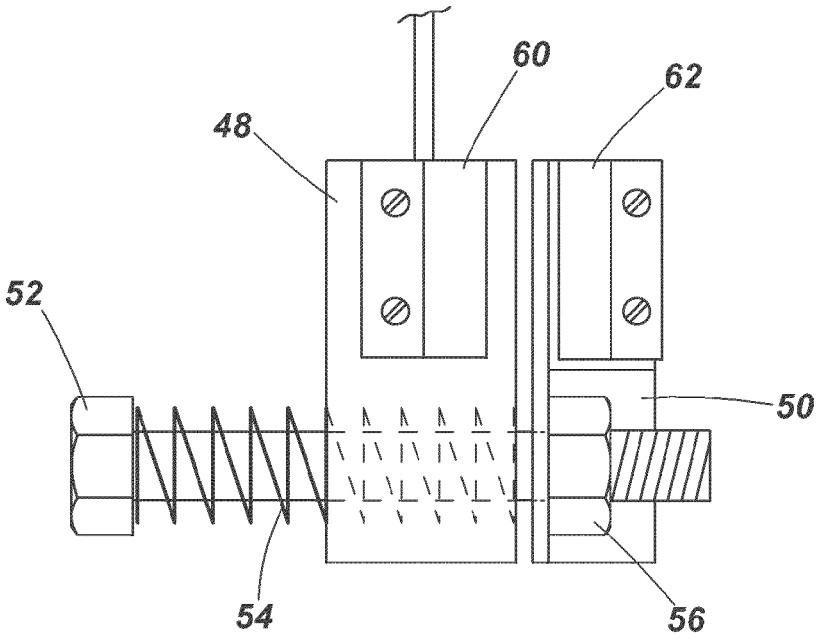
FIG. 8 is a side view at an enlarged scale of a sensing device for the control console.
Figure 9:
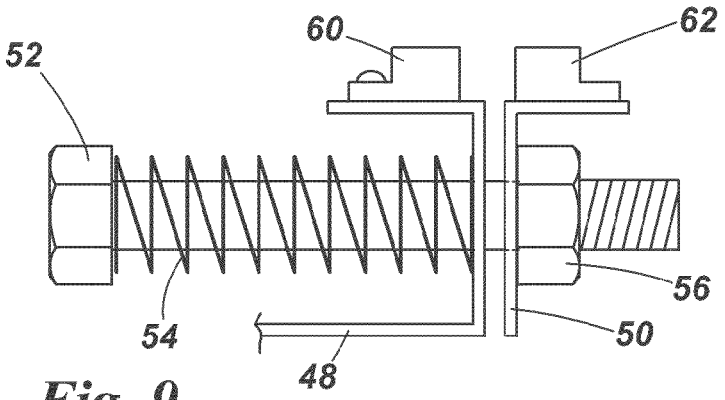
FIGS. 9 and 10 are plan views of the sensing device in unloaded and loaded conditions respectively.
Figure 10:
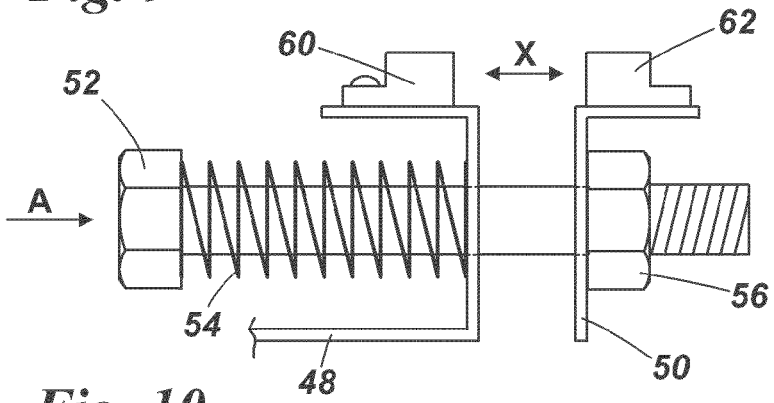

Each recess 42 also accommodates a sensing device 46, one of which is shown in more detail in FIGS. 8-10. The sensing device 46 includes a first bracket 48 that is attached to the console 32 and a second bracket 50 that is attached to the first bracket 48 by a bolt 52 that passes through aligned holes in the brackets and extends outwards on the free side of the first bracket 48. Bracket 50 is prevented from rotating by a stabilising bar (not shown) that is fixed to one bracket and slides within a bush/bearing surface (not shown) that is fixed to the other bracket. The other end of the bolt 52 is received in a thread in the second bracket 50, for example in a nut 56 that is fixed (for example welded) to the second bracket 50. A spring 54 is compressed between the head of the bolt 52 and the first bracket 48, so that the second bracket 50 is drawn towards the first bracket 48. The spring 54 thus urges the two brackets towards one another as shown in FIGS. 8 and 9 with a resilient biasing force that depends on the compression of the spring 54. This biasing force can be adjusted by rotating the bolt 52. Preferably, bolt 52 is selected such that when it is wound to the end of its thread the spring 54 is not over compressed. Preferably, the desired biasing force is achieved when the bolt 52 is wound to the end of its thread. The head of the bolt 52 presses against a striker plate 58 that is attached to one of the cage posts 26. This maintains the control console 32 in the upright position shown in FIGS. 5 and 6.

Figure 7:
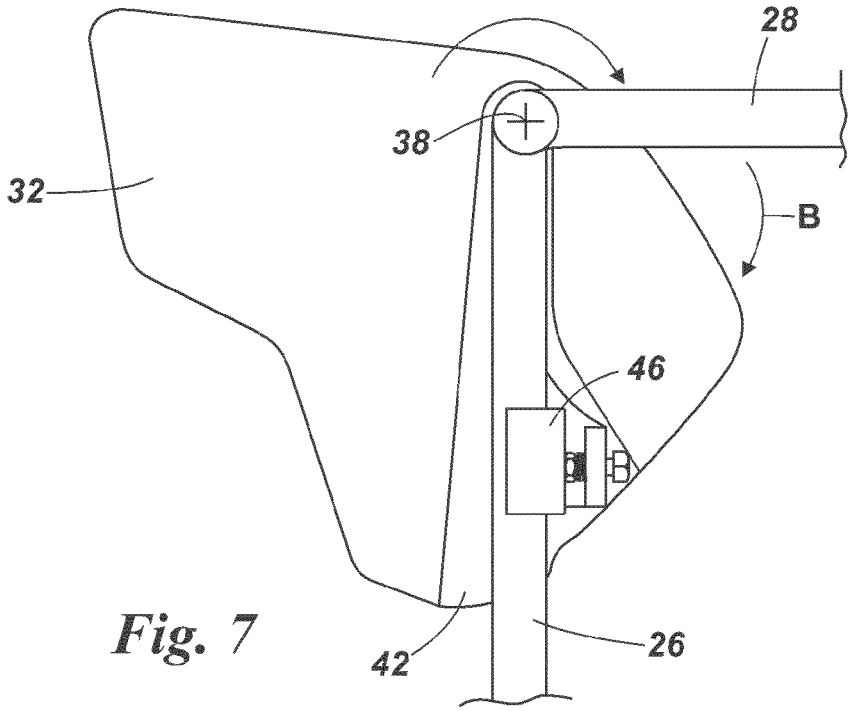
FIG. 7 is a side view of the control console in a loaded condition.

If a force A is applied to the bolt 52 via the striker plate 58, this can cause the separation X of the two mounting brackets 48, 50 to increase as shown in FIG. 10, but only if the force A is greater than the biasing force exerted by the spring 54. This can occur if a large downwards load B is applied to the control console 32 at or near its front edge, as shown in FIG. 7. This causes the console 32 to rotate about the pivot 38 to the tilted position shown in that drawing. When the load B is removed, the console will return under the influence of the springs 54 to the unloaded condition shown in FIGS. 5, 6, 8 and 9.

The sensing device 46 includes a proximity switch 60 or similar sensor that is constructed and arranged to detect movement of the console 32 from the unloaded condition shown in FIGS. 5, 6, 8 and 9 to the loaded condition shown in FIGS. 7 and 10. The proximity switch or sensor is connected to the control system of the MEWP, which is arranged to interrupt the drive system for the work platform to prevent further movement of the platform if the console is in the loaded condition.

In this embodiment, the proximity switch 60 comprises a reed switch attached to the first bracket 48, which is influenced by a magnet 62 that is attached to the second bracket 50. When the control console 32 is unloaded, the reed switch 60 is in a first state allowing the drive system of the platform to be operated. However, when the console 32 is loaded, for example when an operator is trapped against the console, the magnet 62 is displaced away from the reed switch 60 and the switch adopts a second state, disabling the drive system. In this situation, drive can only be restored by removing the load from the console 32 so that it returns to its normal unloaded condition and then resetting the system, or by using an over-ride control.

Preferably the proximity switches 60 will be in a normally closed (N/C) state when the console is unloaded and in a normally open (N/O) state when the console is loaded. This adds an extra level of safety because in the event that a switch is broken or removed, the system will act in the same way as if the magnet had moved away from the proximity switch: that is it will stop the machine. The switch/sensor may provide feedback, for example by means of a light on the control panel, to inform the operator as to what state/condition the switch is in, for example loaded, unloaded, working or not working.

Alternatively other types of switch may be used, for example push buttons or cam activated micro-switches. Alternatively, switches may be located in other positions for example fixed to the cage post. Other types of springs and pre-loads could also be used, for example torsion springs that are assembled around the pivot point of the console.

The sensing system 46 is completely covered by the cover plates 44, making it covert (that is, hidden from view). This reduces the chance of operator complacency and makes the system more difficult to over-ride. Assembling the covers using security screws can reduce this risk further. Covering the sensing system also prevents entanglement, snagging, and the risk of finger trapping.

Alternatively the covers could be manufactured in a bright colour, making it obvious to the operator that the system is installed.

During operation, the control console 32 is biased upwards by the compression springs 54. However, if a sufficient downwards force is applied to the console in the direction of arrow B, the bias force of the springs 54 can be overcome allowing the console to activate one or both of the sensor switches 60. The switches 60 are connected to the control system that controls or restricts operation of the machine when either of the switches is activated. The downward movement of the console 32 also helps to relieve the crushing force felt by the operator 8, while maintaining a barrier between the operator and the controls.

Therefore, if the operator 8 is pressed against the control console 32 as shown in FIGS. 3 and 4, the load sensor 46 senses the external crushing force and activates the control system, which then prevents or restricts further movement of the cage 6, as described above.

Alternatively, pressure sensors or strain gauges may be provided to sense an excessive crush force applied to the console or to a hand rail or support connected to the console. A crush sensor may also be provided elsewhere on the cage, for example on the raised portion 36 at the rear of the upper guard rail 28. Alternatively or additionally, one or more ultrasonic proximity sensors may be mounted on the cage to provide a warning and/or to control or restrict movement of the cage if it comes into close proximity with an obstacle.

The operator cage or features thereof may also be used or designed for use with various types of machine other than mobile elevating work platforms, either as an original feature or as a retrofit. For example, the operator cage may be designed for use with machines such as telescopic handling machines ("telehandlers") or other machines where an operator cage is provided to accommodate (and generally protect) the operator.

The invention claimed is:

1. A control system for a machine having an elevating operator cage with a control console mounted in the operator cage, the control system including a load sensor that senses external loads applied to the control console or to a hand rail or support connected to the control console, a weight sensor for sensing a change in the apparent weight of the cage, a control device, an input for activation signals, an input for control signals, an input for load signals from the load sensor, an input for weight signals from the weight sensor, and an output for drive control signals, wherein the control device is constructed and arranged to issue a stop drive control signal upon receiving a load signal, and to issue an override signal that overrides the stop drive control signal upon receiving an override input signal, wherein, after issuing the stop drive control signal, the control device issues a withdraw signal that causes the machine to reverse at least partially its movements prior to receiving the load signal, and wherein the control device is constructed and arranged to adopt an override mode if the load sensor is released, and to adopt a load sensor activated state if the load sensor is again activated.

2. A control system according to claim 1, wherein the override signal comprises a combination of input signals.

3. A control system according to claim 1, wherein the control device is constructed and arranged to issue a restricted drive control signal that operates to allow the machine to be driven at a reduced speed upon receiving an override input signal.

4. A control system according to claim 3, wherein the restricted drive control signal operates to allow the machine to be driven only in certain directions.

5. A control system according to claim 3, wherein the restricted drive control signal operates to allow only specific components of the machine to be driven.

6. A control system according to claim 1, wherein the control device is constructed and arranged to resume normal operation after receiving a load signal only after the load signal has ceased and any control signal received at the time of receiving the load signal has been cancelled.

7. A control system according to claim 1, including a warning device for issuing a warning signal when a load signal is received.

8. A control system according to claim 1, including a sensor for sensing an excessive crush force applied to the control console.

9. A machine having an elevating operator cage, a control console in the operator cage, a load sensor that senses external loads applied to the console or to a hand rail or support connected to the control console, a weight sensor for sensing a change in the apparent weight of the cage, and a control system that includes a control device, an input for activation signals, an input for control signals, an input for load signals from the load sensor, an input for weight signals from the weight sensor, and an output for drive control signals, wherein the control device is constructed and arranged to issue a stop drive control signal upon receiving a load signal, and to issue an override signal that overrides the stop drive control signal upon receiving an override input signal, wherein after issuing the stop drive control signal the control device issues a withdraw signal that causes the machine to reverse at least partially its movements prior to receiving the load signal, and wherein the control device is constructed and arranged to adopt an override mode if the load sensor is released, and to adopt a load sensor activated state if the load sensor is again activated.

10. A machine according to claim 9, wherein the control console is mounted for pivoting movement relative to the operator cage and the load sensor is constructed and arranged to detect movement of the console from an unloaded condition to a loaded condition.

11. A machine according to claim 10, including resilient biasing means that is constructed and arranged to bias the control console towards the unloaded condition.

12. A machine according to claim 11, wherein the control console is constructed and arranged to be displaced from the unloaded condition only when the external load exceeds a predetermined value.

13. A machine according to claim 9, wherein the load sensor includes a proximity switch.

14. A machine according to claim 13, wherein the proximity switch is normally closed.

15. A machine according to claim 9, wherein the load sensor is located within a substantially closed compartment.

16. A machine according to claim 9, further including a fence assembly comprising an upper rail having a first portion positioned at a first height above the base unit and a second portion positioned at a second height above the base unit, wherein the second height is greater than the first height and the second portion is located above a gateway providing access to the operator cage.

17. A machine according to claim 16, in which the gateway includes a hinged gate below the second portion of the upper rail, wherein one end of the gate is mounted for pivoting movement and the other end is constructed and arranged to be retained throughout its movement.

18. A machine according to claim 9, further comprising a base and an extending structure, wherein the operator cage is attached to the extending structure.

* * * * *